US005112267A

United States Patent [19]

Liu et al.

[11] Patent Number: 5,112,267

[45] Date of Patent: May 12, 1992

[54] TOY VEHICLE WITH MOVABLE BODY COMPONENT

[75] Inventors: Dexter C. Liu, 302 Corey La., Middletown, R.I. 92840; Ronald J. Campanell, 126 Touisset, Touisset, R.I. 02885; Paul J. Kotowski, Foster, all of R.I.

[73] Assignees: Dexter C. Liu; Ronald J. Campanell, Middletown, R.I.

[21] Appl. No.: 632,141

[22] Filed: Dec. 21, 1990

[51] Int. Cl.[5] ..... A63H 17/26; A63H 29/00; F16F 9/30; F03G 1/00

[52] U.S. Cl. ..... 446/470; 446/457; 446/463; 188/268; 188/311; 185/39; 185/DIG. 1; 74/99 A

[58] Field of Search ..... 185/39, DIG. 1; 74/99 A; 188/269, 268, 322.5, 311, 312; 446/470, 471, 457, 462, 463, 464, 486, 487, 460

[56] References Cited

U.S. PATENT DOCUMENTS

| | | | |
|---|---|---|---|
| 2,242,724 | 5/1941 | Kniesner | 185/39 X |
| 2,804,718 | 9/1955 | Follis et al. | 446/9 |
| 3,199,371 | 8/1965 | Lins et al. | 446/457 X |
| 3,619,939 | 11/1971 | Vidal | 446/464 |
| 3,659,375 | 5/1972 | Stubbmann | 446/7 |
| 3,748,780 | 7/1973 | Glass et al. | 446/464 |
| 3,968,862 | 7/1976 | Gorges et al. | 188/268 X |
| 4,160,494 | 7/1979 | McCambridge | 446/470 X |
| 4,194,318 | 3/1980 | Watanabe | 446/435 |
| 4,471,564 | 9/1984 | Beny | 446/486 |
| 4,504,242 | 3/1985 | Crain et al. | 446/429 |
| 4,648,613 | 3/1987 | Hennessy | 74/99 X |
| 4,657,518 | 4/1987 | Kelley et al. | 185/DIG. 1 X |
| 4,768,627 | 9/1988 | Taylor | 188/312 X |
| 4,825,983 | 5/1989 | Nakanishi | 188/322.5 X |

FOREIGN PATENT DOCUMENTS

| | | | |
|---|---|---|---|
| 0204338 | 12/1986 | European Pat. Off. | 446/464 |
| 1040888 | 9/1966 | United Kingdom | 446/470 |
| 2205256 | 12/1988 | United Kingdom | 446/464 |

*Primary Examiner*—David N. Muir
*Attorney, Agent, or Firm*—Salter & Michaelson

[57] ABSTRACT

A toy vehicle includes a body-and-chassis assembly comprising a main portion and a movable body component which is movable relative to the main portion. The toy vehicle further includes a manually operable operating mechanism in the body-and-chassis assembly for moving the movable body component between first and second positions thereof with a relatively slow steady dampened movement which simulates the movement of a body component of a full-sized vehicle.

15 Claims, 8 Drawing Sheets

TOY VEHICLE WITH MOVABLE BODY COMPONENT

BACKGROUND AND SUMMARY OF THE INVENTION

The instant invention relates to toy vehicles, and more particularly a toy vehicle comprising a movable body component which is movable with a realistic action movement.

Toy vehicles, including toy cars, trucks, off-road vehicles and the like, have been found to be relatively popular with children of various ages. Further, toy vehicles which include various movable body components, such as movable windows, hoods, trunk lids, or sun roofs, have been found to have increased levels of appeal. However, it has been found that the heretofore available operating mechanisms for moving the movable body components of toy vehicles have generally been incapable of moving the movable components thereof with realistic action movements. Specifically, it has been found that the operating mechanisms of the movable body components of the heretofore available toy vehicles have only been operable for moving components thereof with relatively abrupt action movements which fail to simulate the types of slow and steady action movements normally associated with the movable body components of full-sized vehicles. For this reason, while toy vehicles which have included movable body components have been found to be relatively popular, the appeal of such vehicles has been at least somewhat limited by the inability of the operating mechanisms thereof to operate the movable components thereof with realistic action movements.

The instant invention provides a toy vehicle comprising a movable body component and an operating mechanism which is operative for moving the movable body component thereof with a realistic action movement. More specifically, the instant invention provides a toy vehicle comprising a movable body component, such as a sun roof, a window, a hood, or a trunk lid, and an operating mechanism which is operative for moving the movable body component with a relatively deliberate dampened action movement so that the movable component is operable with an action movement which is more similar to that normally associated with a movable component of a full-sized vehicle. For example, when the movable component of the toy vehicle of the subject invention comprises a vehicle window, the operating mechanism is operable for moving the vehicle window between open and closed positions thereof with a slow, dampened action which more closely resembles the type of movement normally associated with an electrically-operated window of a full-sized vehicle.

The toy vehicle of the subject invention comprises a body-and-chassis assembly including a main portion and at least one movable component, such as a window, a sun roof, a trunk lid, or a hood, which is movable relative to the main portion between first and second positions thereof. The toy vehicle further includes an operating mechanism which is operative for moving the movable component between the first and second positions thereof with a dampened action so that the movable component is movable with a realistic action movement. Specifically, the operating mechanism includes an actuator member which is movable between first and second positions thereof, a linkage member which is movable by means of the actuator member for movement between first and second positions thereof, resilient biasing means which is operatively connected between the linkage member and the movable component such that when the movable component is in the first position thereof, movement of the linkage member from the first position thereof to the second position thereof causes the resilient biasing means to resiliently bias the movable component toward the second position thereof. The operating mechanism still further comprises dampening means for dampening the movement of the movable component toward the second position thereof from the first position thereof. The operating mechanism preferably comprises first and second linkage members, and the first linkage member is preferably movable for causing the resilient biasing means to resiliently bias the movable component toward the second position thereof. The second linkage member is also movable between first and second positions thereof and it is preferably operatively connected to the biasing means for moving the movable component with the biasing means through the second linkage member. The dampening means preferably includes a viscous dampening fluid which is operatively interposed between the biasing means and the second linkage member so that relative movement between the first and second linkage members is dampened by the viscous fluid. In one embodiment the first and second linkage members comprise rotatable disks which are rotatable for movement between the respective first and second positions thereof. In this embodiment the dampening means preferably includes a cavity member having a circular cavity therein, and a viscous fluid in the cavity. The second rotatable disk is mounted in the cavity in contact with the viscous fluid such that rotation of the second rotatable disk in the cavity is dampened by the viscous fluid. In this embodiment the cavity member is mounted in a stationary position relative to the main portion of the body-and-chassis assembly so that rotation of the first rotatable disk causes the biasing means to be loaded against the second rotatable disk, and so that the rotation of the second rotatable disk is dampened by the viscous fluid in the cavity. Accordingly, the movement of a movable component operatively connected to the second rotatable disk is also dampened by the viscous fluid in the cavity.

In a second embodiment of the toy vehicle of the subject invention the second linkage member comprises a cylinder member having an open cavity formed therein and the viscous fluid is located in the cavity in the cylinder member. In this embodiment the dampening means comprises a shaft of preferably non-circular cross section which is rotatably received in the cavity and secured in a fixed position relative to the main portion of the body-and-chassis assembly. In this embodiment, rotation of the first linkage member causes the biasing means to be loaded against the cylinder member and the viscous fluid in the cylinder member dampens the rotation of the cylinder member relative to the shaft therein. Accordingly, movement of a movable component attached to the cylinder member is also dampened by the fluid in the cylinder member.

In a third embodiment of the toy vehicle of the subject invention the dampening means comprises a cylinder member having an open cavity formed therein and a viscous fluid in the cavity. In this embodiment the cylinder member is secured in a fixed position relative to the main portion of the body-and-chassis assembly and the second linkage member comprises a piston element which is movable in the cylinder member. In this embodiment the biasing mean is operative for biasing the piston element to an advanced position in the cylinder member when the first linkage member is moved from a first position thereof to a second position thereof, and the viscous fluid in the cylinder member is operative for dampening longitudinal movement of the piston element in the cylinder member.

It has been found that the toy vehicle of the subject invention is operative with substantially more realistic action movements than the heretofore available toy vehicles and that as a result it has a substantially increased play value. Specifically, it has been found that because the movable body component of the toy vehicle of the instant invention is movable with a dampened motion, rather than with an abrupt direct motion, it is operative with a motion which more closely resembles that of an actual movable body component of a full-sized vehicle. It has been further found that as a result of this feature the toy vehicle of the subject invention has a significantly increased level of play value.

Accordingly, it is a primary object of the instant invention to provide a toy vehicle comprising a movable body component which is operative with a realistic action movement.

Another object of the instant invention is to provide a toy vehicle comprising a movable body component which is movable with a dampened action so that the movement thereof more closely simulates the movement of an actual vehicle component.

An even still further object of the instant invention is to provide a toy vehicle which includes an operating mechanism comprising means for resiliently biasing a movable body component on the vehicle for movement from a first position toward a second position, and means for dampening the movement of the movable component from the first position toward the second position thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
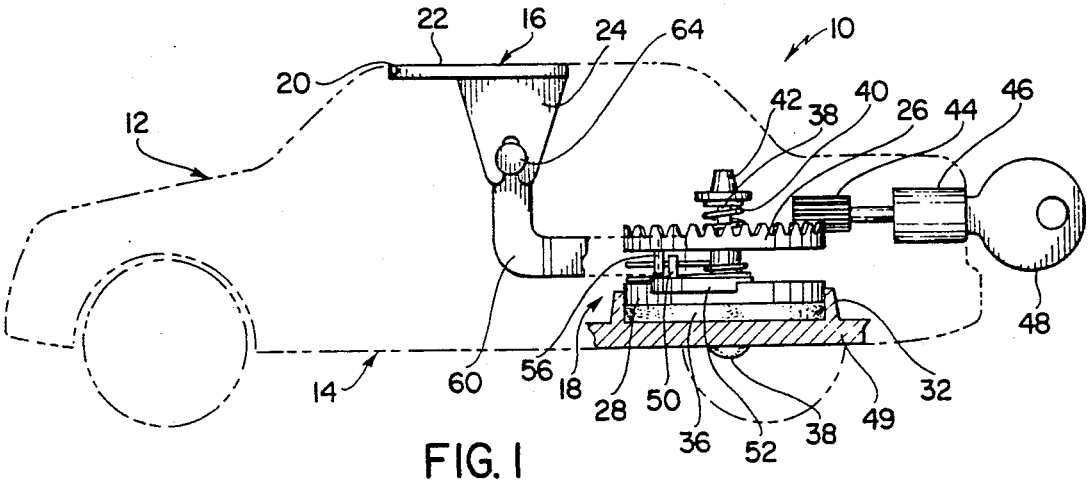
FIG. 1 is a side elevational view of a first embodiment of the toy vehicle of the instant invention with the main portion of the body-and-chassis assembly thereof illustrated in phantom.

Referring now to the drawings, a first embodiment of the toy vehicle of the instant invention is illustrated in FIGS. 1–5 and generally indicated at 10 in FIGS. 1–4. The toy vehicle 10 includes a body-and-chassis assembly generally indicated at 12 comprising a main portion generally indicated at 14 and a movable body component generally indicated at 16. The vehicle 10 further comprises an operating mechanism generally indicated at 18 which is operative for moving the movable component 16 between the first position thereof illustrated in FIGS. 1–3 and the second position thereof illustrated in FIG. 4.

Specifically, the operating mechanism 18 is operative for moving the movable component 16 with a dampened motion so that the movable component 16 is moved between the first and second positions thereof with a motion which more closely resembles that of an electrically operated sun roof on a full-sized vehicle.

The body-and-chassis assembly 12 includes the main portion 14 and the movable component or sun roof 16. The main portion 14 is of conventional construction and it may be embodied as either a car, a truck, or any other type of vehicle. In any event, the main portion 14 as herein embodied includes a sun roof opening 20 in the upper roof area thereof. The movable component 16 comprises a sun roof portion 22 which is receivable in the sun roof opening 20 and an operating arm portion 24 which extends downwardly from the sun roof portion 22.

Figure 2:
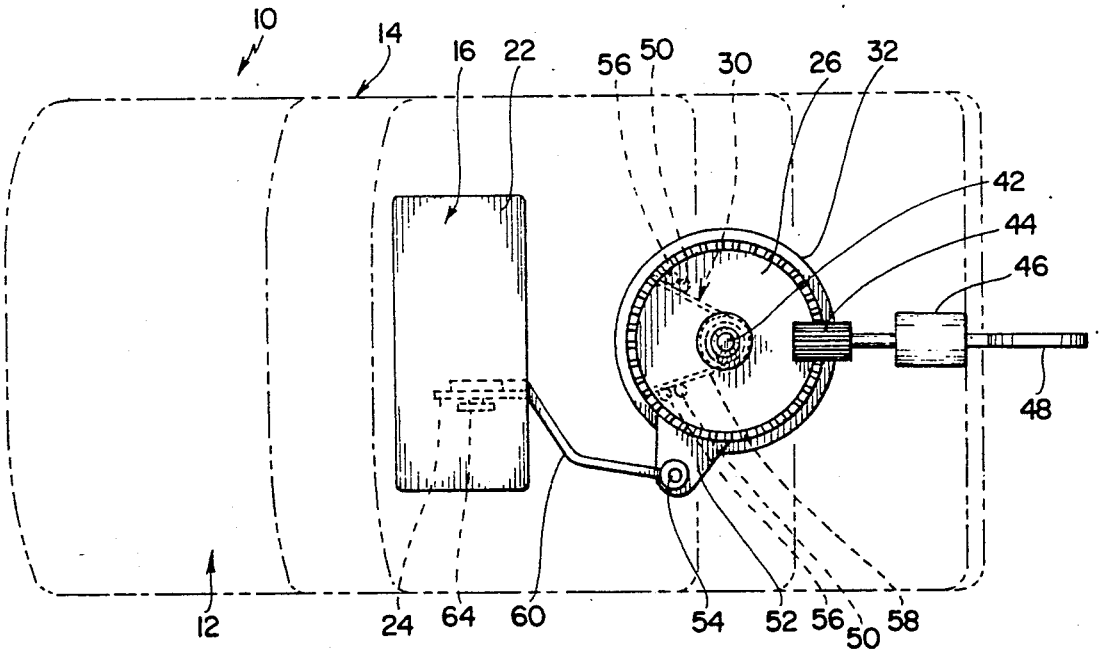
FIG. 2 is a top plan view thereof with the first linkage member and the movable component thereof in the respective first positions thereof.
Figure 3:
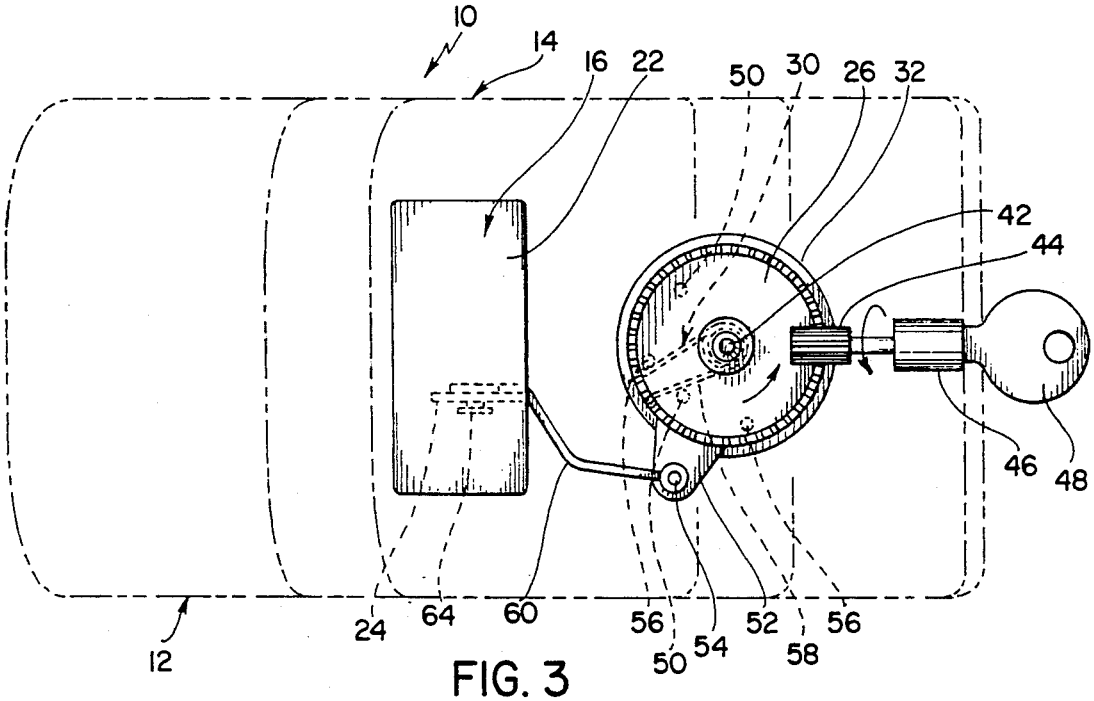
FIG. 3 is a similar view with the first linkage member thereof in the second position thereof, but the movable component thereof in the first position thereof.
Figure 4:
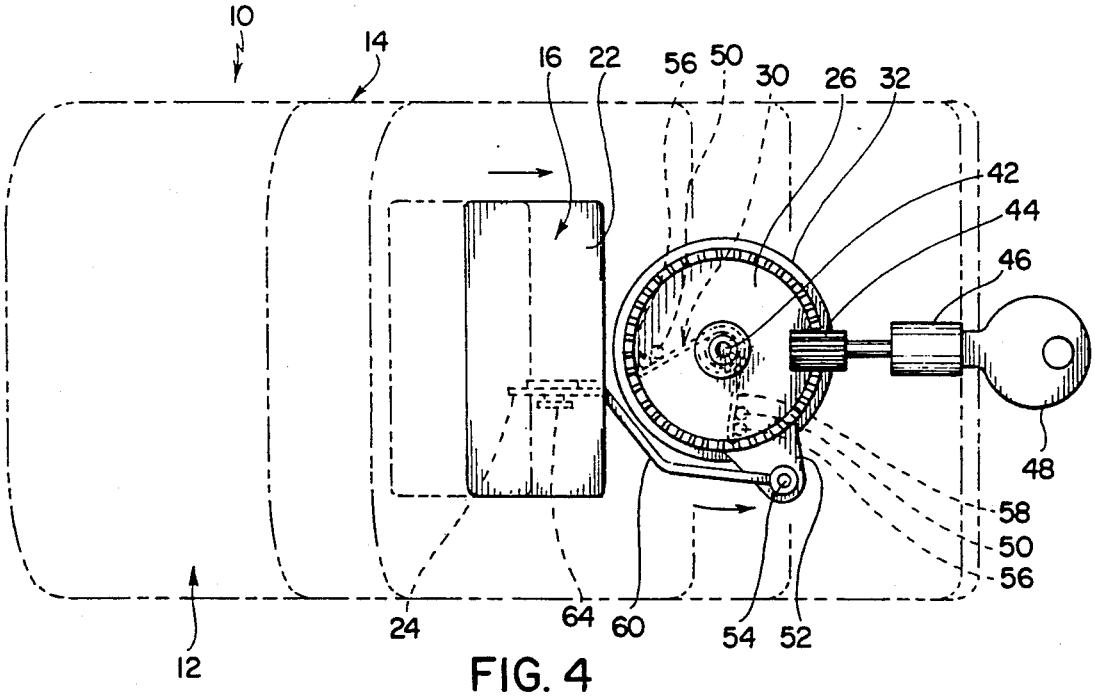
FIG. 4 is a similar view with both the first linkage member thereof and the movable component thereof in the second positions thereof.
Figure 5:
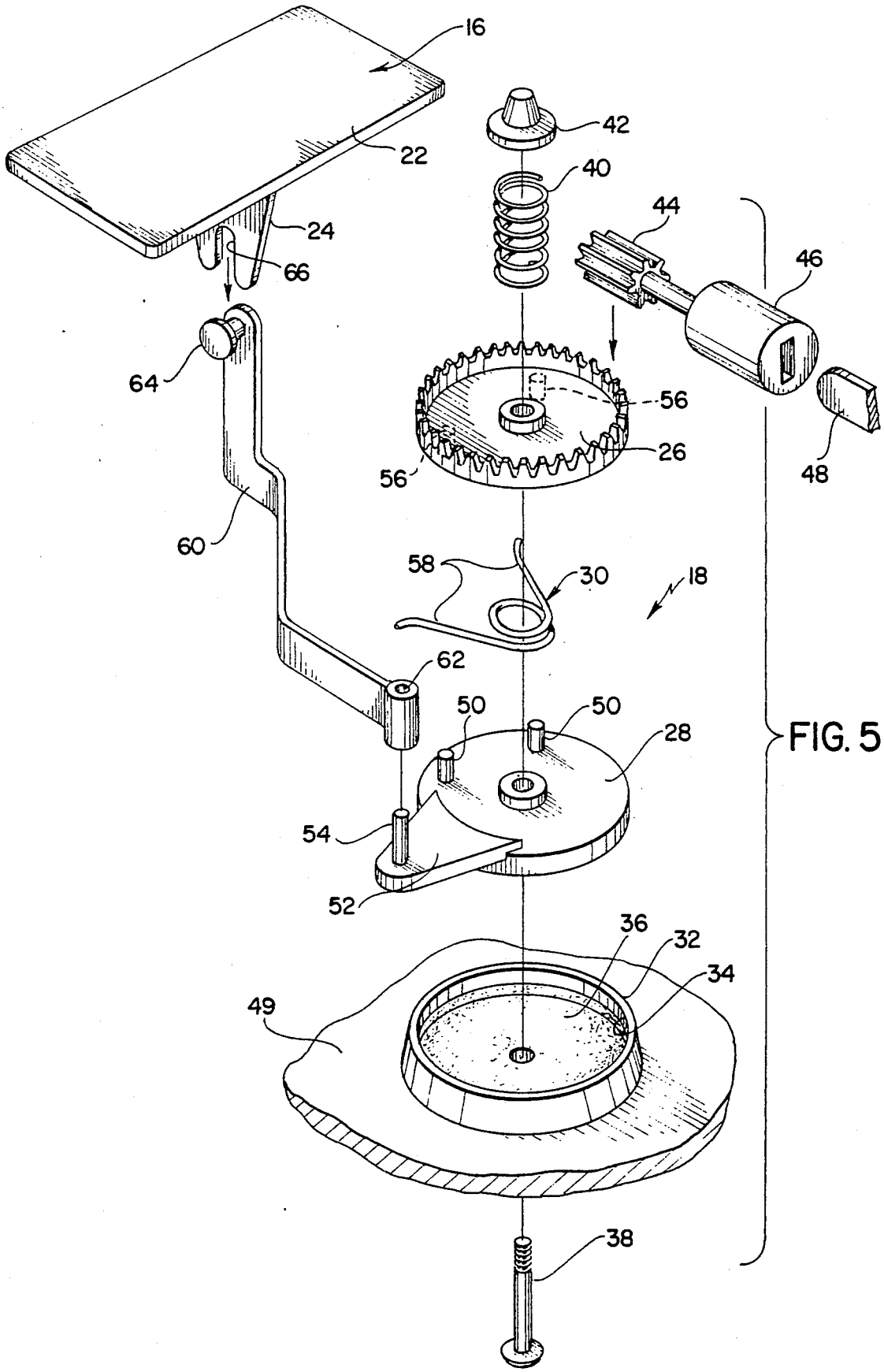
FIG. 5 is an exploded perspective view of the operating mechanism of the first embodiment of the toy vehicle.

The operating mechanism 18 is illustrated most clearly in FIG. 5 and it comprises a first or gear disk 26, a second or drive disk 28, a torsion spring 30, a cavity member 32 having an open cylindrical cavity 34 therein, and a viscous liquid 36 in the cavity 34. The operating mechanism 18 further includes a threaded screw 38, a coil spring 40, a threaded cap 42, a pinion gear 44, a key socket 46 and a key 48. The key 48, the key socket 46, and the pinion gear 44 cooperate to provide a rotatable actuator assembly and the gear disc 26 provides a linkage between the actuator assembly and the spring 30. The drive disk 28 is received in the cavity 34 so that it is in intimate contact with the viscous fluid 36, and accordingly, the viscous fluid 36 is operative for retarding the rotation of the drive disk 28 relative to the cavity member 32. In this connection, the viscous fluid 36 preferably comprises a fluid such as heavy residual oil having a relatively high viscosity at room temperature so that it can be effectively utilized for retarding the rotation of the drive disc 28. The cavity member 32 is secured in a fixed position on a plate 49 which comprises part of the main portion 14 of the body-and-chassis assembly 12 and hence, the cavity member 32 is secured in a fixed position relative to the main portion 14. The drive disk 28 has a pair of spaced upwardly extending pins 50 thereon and a drive arm 52 extends outwardly from the disk 28 and includes an upwardly extending pin 54. The gear disk 26 has a pair of downwardly extending pins 56 thereon, and the torsion spring 30 includes a pair of arms 58. The screw 38 extends through the plate member 49, the cavity member 32, the drive disk 28, the spring 30, and the gear disk 26 so that the torsion spring 30 is received between the drive disk 28 and the gear disk 26 with the arms 58 captured between the pins 50 and 56, as illustrated in FIGS. 2–4. The spring 40 is received on the screw 38 above the gear disk 26, and the cap 42 is threadedly received on the upper end of the screw 38 to retain the spring 40, the gear disk 26, the spring 30, the drive disk 28, and the cavity member 32 in assembled relation. The pinion gear 44 is attached to the key socket 46 which is rotatably mounted in the main portion 14 by suitable means (not shown). In this regard, the key socket 46 is mounted so that the pinion gear 44 intermeshes with the gear disk 26 so that rotation of the key socket 46 with the key 48 causes corresponding rotation of the gear disk 26.

Accordingly, for use of the operating mechanism 18, the key 48 is inserted into the key socket 46 and the key 48 is rotated to rotate the key socket 46, the pinion gear 44, and the gear disk 26 from respective first positions thereof to respective second positions thereof. As illustrated in FIGS. 2–4, when the key 48 is rotated to rotate the gear disk 26, one of the pins 56 on the gear disk 26 cooperates with one of the pins 50 on the drive disk 28 to move the spring arms 58 together so that the spring 30 is loaded to a position wherein it operates to bias the drive disk 28 from a first position to a rotated second position corresponding to the rotated position of the gear disk 26. However, because the drive disk 28 is in intimate contact with the viscous liquid 36, rotation of the drive disk 28 is retarded by the viscous liquid 36. Hence, while the gear disk 26 is rotated to the second position thereof relatively quickly in direct relation to the key 48 as the key 48 is turned, the drive disk 28 is rotated at a much slower rate so that it takes at least 2 or 3 seconds to reach the second position thereof.

Also included in the operating mechanism 18 is a linkage member 60 having a sleeve 62 formed at one end thereof and a pin 64 formed at the opposite end thereof. The linkage member 60 extends between the drive arm 52 on the drive disk 28 and the drive arm 24 on the movable component 16. Specifically, the pin 54 is received in the sleeve 62 and the pin 64 is received in a slot 66 in the drive arm 24. Accordingly, as the drive disk 28 is rotated to the second position thereof by the biasing force of the spring 30 to either move the drive arm 52 rearwardly or forwardly, the linkage member 60 is moved in a corresponding direction to move the movable component 16 rearwardly from a first position thereof to a second position thereof or forwardly back to the first position thereof, respectively. In this regard, because the pin 64 is loosely received in the slot 66, the linkage member 60 can effectively move the movable component 16 as the drive disk 28 is rotated regardless of the angular orientation of the linkage member 60 relative to the drive arm 24.

Accordingly, for use and operation of the vehicle 10 the key 48 is inserted into the key socket 46. As illustrated in FIG. 3, the key 48 is then rotated approximately one-quarter turn to rotate the gear disk 26 from the first position thereof to the second position thereof. As illustrated in FIG. 4, this causes corresponding rotation of the drive disk 28 from a first position thereof to a second position thereof at a substantially reduced rate of rotation as a result of the viscous fluid 36. Further, as the drive disk 28 is rotated from the first position thereof to the second position thereof the linkage member 60 moves the movable component 16 rearwardly to move the sun roof element 22 to an open position.

Figure 6:
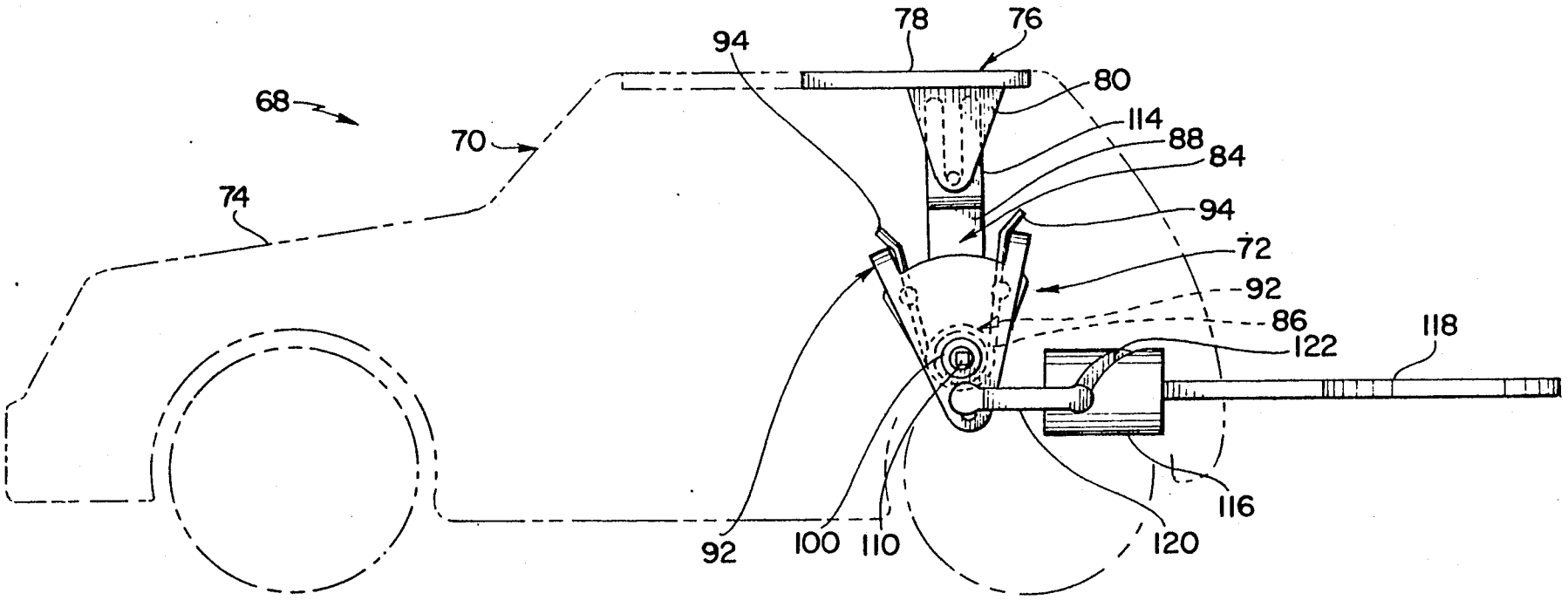
FIG. 6 is a side elevational view of a second embodiment of the toy vehicle with the main portion of the body-and-chassis assembly illustrated in phantom and with both the first linkage member thereof and the movable component thereof in the first positions thereof.
Figure 7:
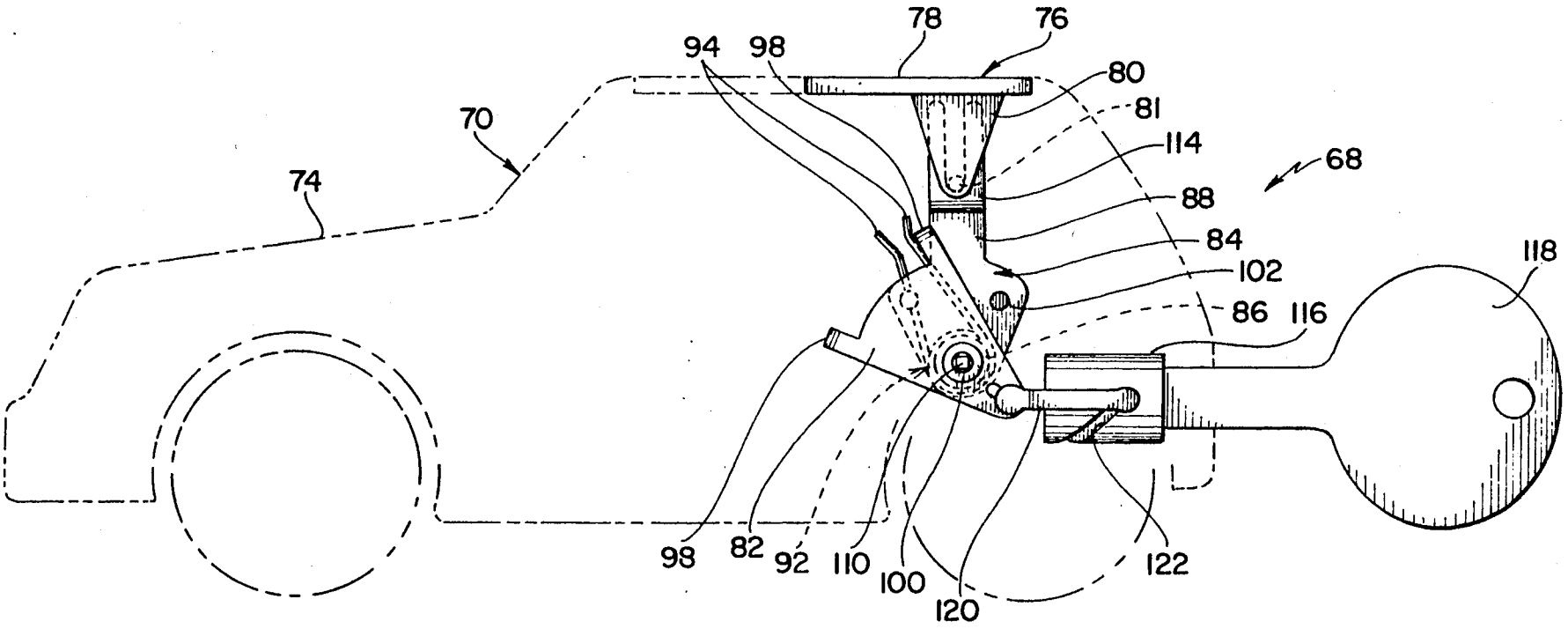
FIG. 7 is a similar view with the first linkage member thereof in the second position thereof and the movable component thereof in the first position thereof.
Figure 8:
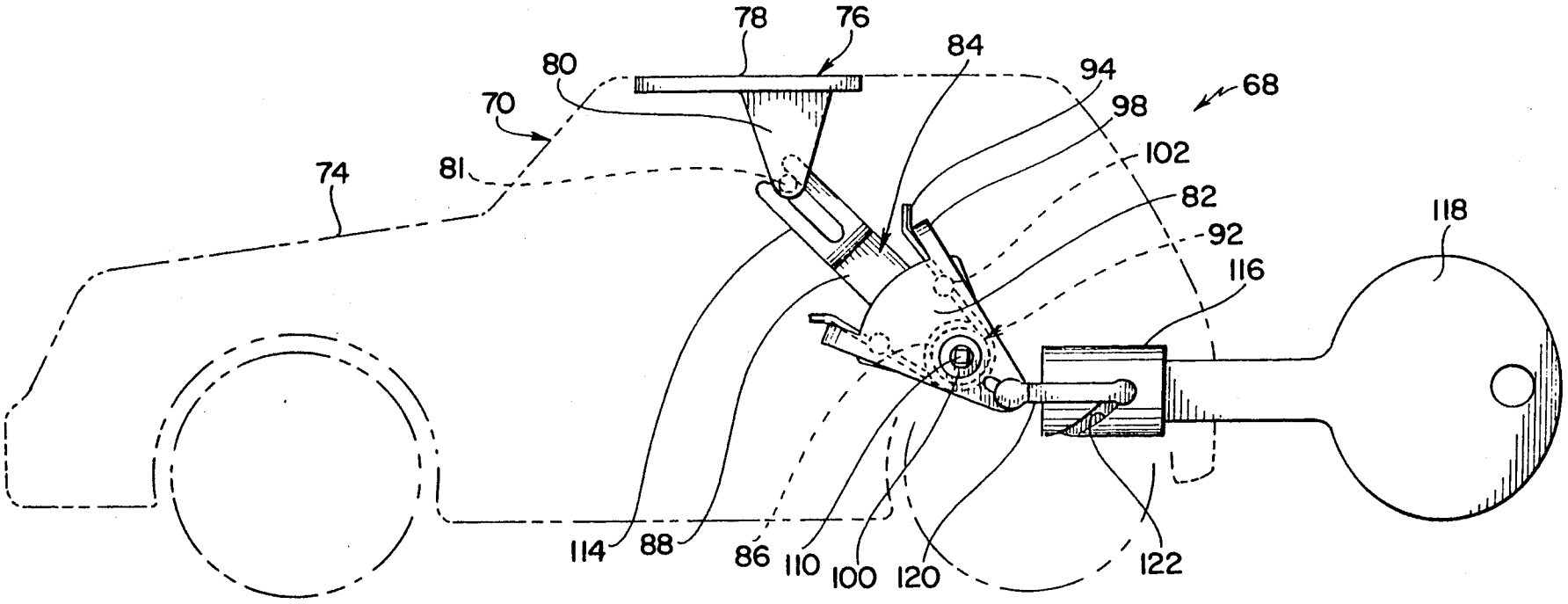
FIG. 8 is a similar view with the first linkage member thereof and the movable component thereof in the second positions thereof.

A second embodiment of the toy vehicle of the instant invention is illustrated in FIGS. 6–11 and generally indicated at 68 in FIGS. 6–8. The vehicle 68 includes a body-and-chassis assembly 70 and an operating mechanism generally indicated at 72. The body-and-chassis assembly 70 comprises a main portion 74 and a movable body component 76 which is movable between the first or open position illustrated in FIG. 6 and the second or closed position illustrated in FIG. 8. The main portion 74 of the body-and-chassis assembly 70 includes a sun roof opening in the upper roof portion of the vehicle 70 and the movable body component 76 includes a sun roof member 78 which is slidably mounted in the sun roof opening. The movable body component 76 further comprises a pair of drive arms 80 which extend downwardly from the sun roof member 78 thereof, the arms 80 having a rod 81 extending therebetween.

Figure 10:
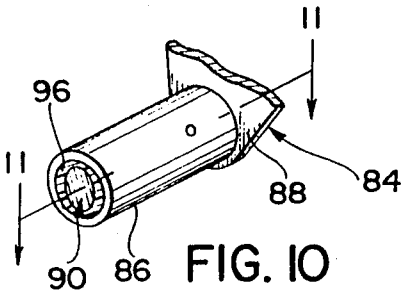
FIG. 10 is a fragmentary sectional view of the cylinder member and shaft thereof.
Figure 11:
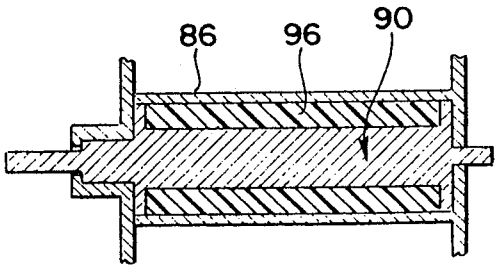
FIG. 11 is a sectional view taken along line 11—11 in FIG. 10.
Figure 9:
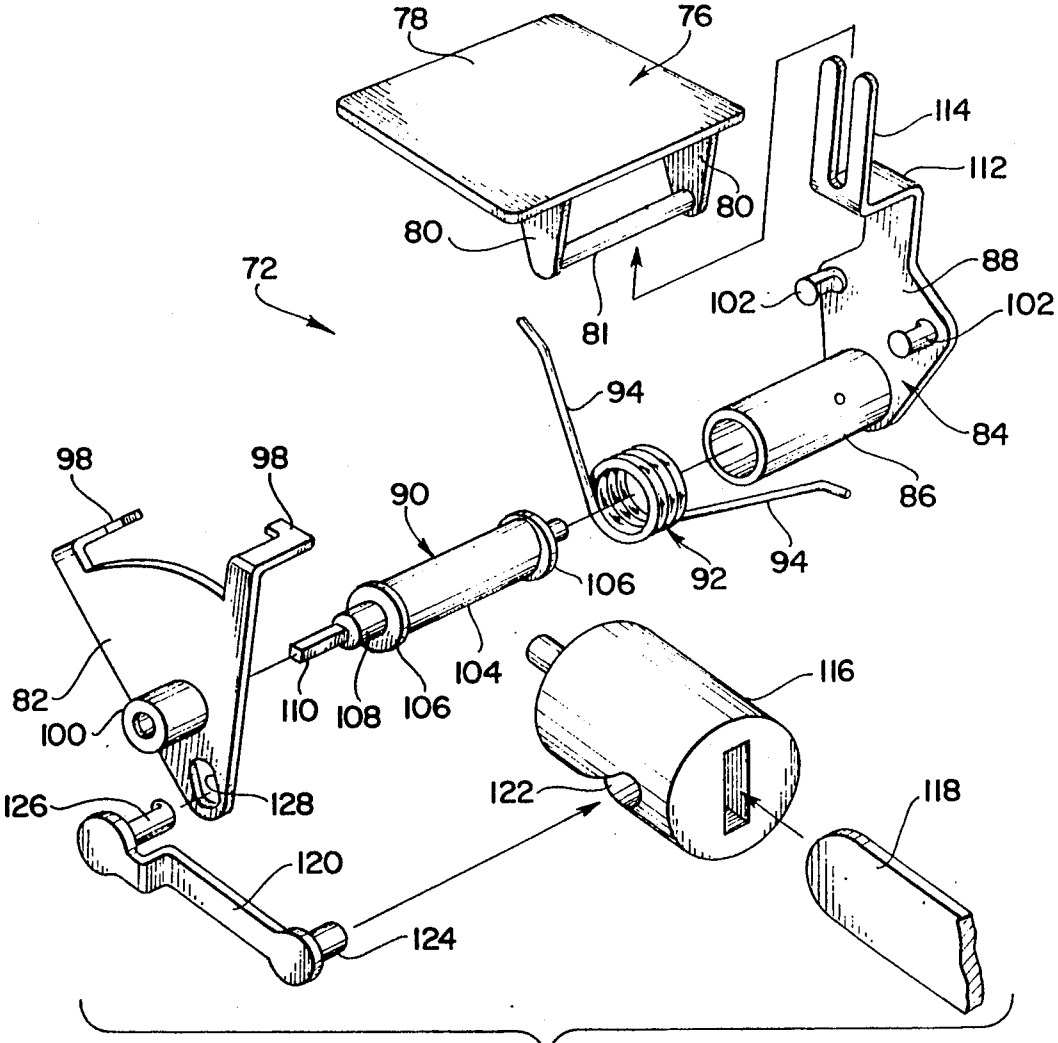
FIG. 9 is an exploded perspective view of the operating mechanism thereof.

The operating mechanism 72 is illustrated most clearly in FIGS. 9–11 and it comprises a linkage member or a plate 82, and a linkage member assembly 84 comprising a cylinder member 86, and a second plate 88. The operating mechanism 72 further comprises a shaft 90, a torsion spring 92 having arms 94 and a viscous fluid 96 in the cylinder member 86. The plate 82 includes a pair of integrally formed, spaced arms 98 and a socket 100, and a pair of pins 102 are also provided on the plate 88. The shaft 90 includes a central portion 104 of non-circular cross section, a pair of flanges 106 at opposite ends of the central portion 104, an end shaft portion 108, and a rectangular terminal end portion 110. The shaft 104 is assembled in the cylinder 86 so that the viscous fluid 96 is captured between the shaft 90 and the cylinder 86, and the spring 92 is captured between the plates 82 and 88 so that the spring arms 94 are positioned between the arms 98 and the pins 102. The viscous fluid 96 is selected so that it is effectively operative for retarding the rotation of the shaft 90 by a significant extent. The shaft 90 is further assembled so that the end shaft portion 108 is received in the socket 100 and so that the rectangular terminal end portion 110 extends outwardly from the socket 100. Further, the terminal end portion 110 is secured by suitable means (not shown) in the main portion 74 of the body-and-chassis assembly 76 so that the shaft 90 is non-rotatable relative to the main portion 74. Accordingly, by rotating the first movable member 82 about the axis of the shaft 90, the spring arms 94 cooperate to communicate a rotational force to the second movable member assembly 84. However, because the second movable member assembly 84 is mounted on the shaft 90 the viscous fluid 96 retards the rotation of the second movable member assembly 84. Consequently, as the plate 82 is rotated the spring arms 94 are drawn together and the spring 92 is moved to a loaded position. However, as the second movable member assembly 84 is gradually rotated by the force of the spring 92, the arms 94 are again separated as the spring 92 is moved to a more relaxed position. As a result, when the plate 82 is rotated, a corresponding degree of rotation is effected in the second movable member assembly 84, although the second movable member assembly 84 is rotated at a substantially slower rate.

Integrally connected to the second movable member assembly 84 is a linkage member 112 having a forked upper end 114. The rod 81 is received in the forked upper end 114 so that the movable body component 76 is moved forwardly or rearwardly by the operating mechanism 72 as the first movable member 82 is rotated to rotate the second movable member assembly 84.

Also included in the operating mechanism 72 is a key socket 116, a key 118, and a linkage member 120. The key 118 and the key socket 116 form an actuator assembly for operating the linkage member 12 and the plate 82. The key socket 116 has a helical slot 122 formed therein and a pin 124 on the linkage member 120 is received in the slot 122. The socket 116 is rotatably mounted by means (not shown) in the main portion 74 of the body-and-chassis assembly 68 so that it is rotatable with the key 118 for repositioning the pin 124 in the slot 122. A pin 126 on the linkage member 120 is received in an aperture 128 in the first movable member 182 so that longitudinal movement of the linkage member 120 causes rotation of the first movable member 82.

Accordingly, for use and operation of the second embodiment 68 of the toy vehicle of the subject invention, the key 118 is inserted into the key socket 116, and the key 118 is rotated to move the pin 124 in the helical slot 122 so that the plate 82 is rotated by the linkage member 120. As the plate 82 is moved from a first position thereof to a second position thereof, the spring 92 is moved to a loaded position and the linkage member assembly 84 is gradually moved from a first position thereof to a second position thereof to gradually move the movable component 76 from a first position thereof to a second position thereof.

Figure 12:
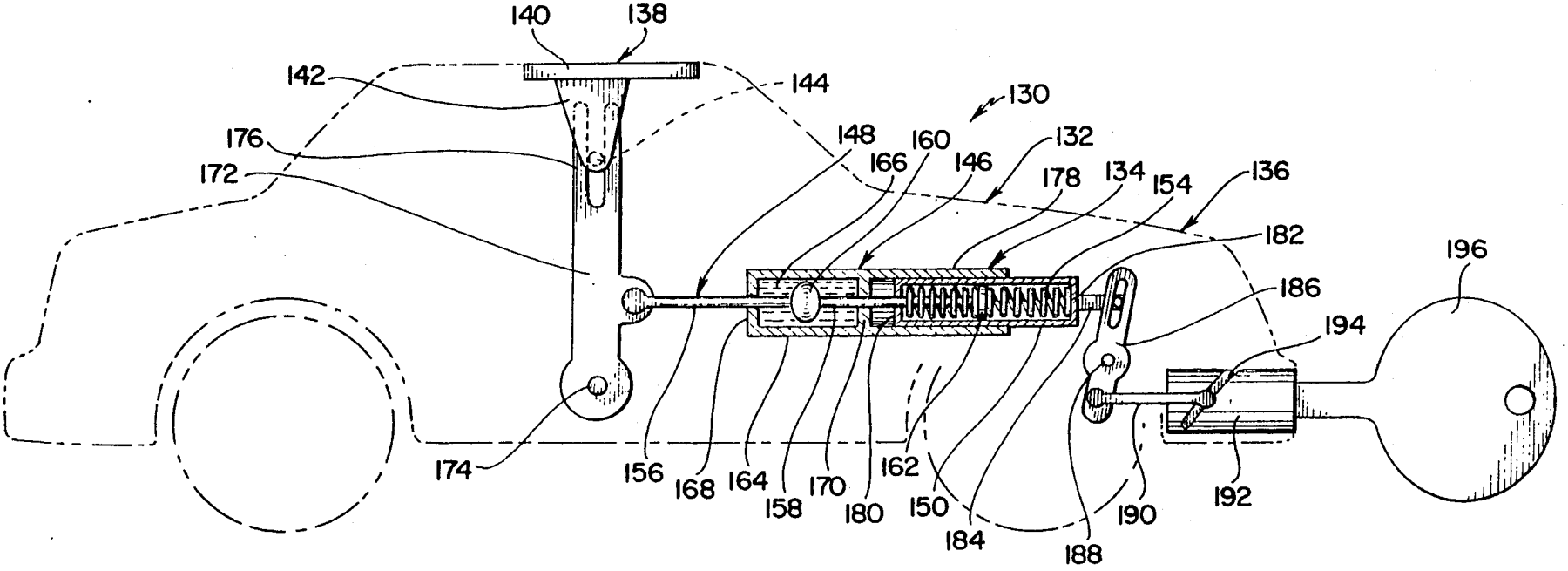
FIG. 12 is a side elevational view of a third embodiment of the toy vehicle with the operating mechanism thereof illustrated partially in section and the main portion of the body-and-chassis assembly thereof illustrated in phantom.

A third embodiment of the toy vehicle of the subject invention is illustrated in FIG. 12 and generally indicated at 130. The toy vehicle 130 includes a body-and-chassis assembly generally indicated at 132 and an operating mechanism generally indicated at 134.

The body-and-chassis assembly 132 comprises a main portion generally indicated at 136 and a movable body component generally indicated at 138. The main portion 136 as herein embodied is formed in the configuration of a conventional automobile having a sun roof opening in the upper roof area thereof. The movable body component 138 comprises a sun roof element 140 which is slidably mounted in the sun roof opening in the upper roof area of the main portion 136 so that it is movable between a forward closed position and a rearward open position. A pair of arms 142 extend downwardly from the sun roof member 140 and a rod 144 extends between the arms 142.

The operating mechanism 134 includes a cylinder member generally indicated at 146, a piston member generally indicated at 148, a spring housing 150, and first and second coil springs 152 and 154, respectively. The piston member 148 includes first and second shaft portions 156 and 158, a piston portion 160, and an end member 162. The cylinder member 146 includes a closed chamber portion 164 containing a viscous fluid 166. The chamber portion 164 has end walls 168 and 170, and the shaft portions 156 and 158 pass sealingly through end wall portions 168 and 170, respectively, so that the piston portion 160 is located in the enclosed chamber portion 164. Accordingly, as the piston member 148 is moved longitudinally in the cylinder member 146 to reposition piston portion 160 in the chamber portion 164 the viscous fluid 166 retards the movement of the piston portion 160.

The cylinder member 146 is secured in a fixed position in the main portion 136 of the body-and-chassis assembly 132, and the shaft portion 156 of the piston member 148 is pivotally secured to a linkage member 172. The linkage member 172 is pivotally mounted in the main portion 136 about a pivot point 174, and it includes a forked upper end portion 176. The rod 144 is received in the forked upper end portion 176 so that as the linkage member 172 is pivoted about the pivot point 174, the movable component 138 is moved forwardly or rearwardly depending upon the direction of pivotal movement.

The cylinder member 146 also includes an open chamber portion 178 and the spring housing 15 is slidably received in the open chamber portion 178. As illustrated, the spring housing 150 is of tubular configuration and it includes an end wall section 180 and the shaft 158 passes through the end wall section 180 so that the terminal end element 162 is located in the interior of the spring housing 150. The opposite end of the spring housing 150 is defined by an end wall 182 and the first spring 154 is captured between the terminal end element 162 and the end wall 182, whereas the second spring 152 is received on the shaft portion 158 so that it is captured between the end wall section 180 and the terminal end element 162. Accordingly, by moving the spring housing 150 further inwardly into the cylinder portion 178 the spring 154 is temporarily loaded due to the resistance of the piston element 160 in the fluid 166, and after the spring 154 has returned to its original position by moving the spring housing 150 outwardly from the cylinder portion 178 the spring 152 is temporarily loaded by the resistance of the piston element 160 in the fluid 166. Attached to the end wall 182 is an extension member 184 and a linkage member 186 is pivotally attached to the extension member 184. The linkage member 186 is pivotally mounted in the main portion 136 of the body-and-chassis assembly 132 about a pivot point 188, and it is pivotally attached to a linkage member 190 which extends to a rotatably mounted key socket 192. The key socket 192 has a helical slot 194 therein and the linkage member 190 is received in the slot 194 so that it is longitudinally repositioned relative to the main portion 136 when the key socket 192 is rotated. A key 196 is removably receivable in the key socket 192 for rotating the key socket 192 to reposition the linkage member 190 in the slot 194. As a result, the key 196 and the key socket 192 cooperate to provide an actuator assembly for actuating the linkage member 190 and the component operatively connected thereto.

Accordingly, by rotating the key 196 by approximately one-quarter turn the linkage member 190 is longitudinally repositioned to reposition the spring housing 150 in the chamber portion 178. When the spring housing 150 is repositioned in the chamber portion 178 the piston member 148 is biased by either the spring 152 or the spring 154 to cause longitudinal movement of the piston portion 160 in the fluid 166. This causes a retarded movement of the piston member 148 which causes the linkage member 172 to be pivoted at a retarded rate for slowly repositioning the sun roof element 140 relative to the main portion 136.

It is seen therefore that the instant invention provides an effective toy vehicle comprising a movable component which is movable at a retarded rate of speed so that the movement thereof more closely simulates the movement of a movable component on a full-sized vehicle. Accordingly, the vehicles 10, 68 and 130 are capable of operating with realistic action movements which significantly add to their play value. Hence, it is seen that the vehicles 10, 68 and 130 represent significant improvements in the toy art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A toy vehicle comprising:

a) a body and chassis assembly including a main body portion and at least one movable body component which is movable relative to said main body portion between first and second positions thereof; and b) an operating mechanism for moving said movable body component between the first and second positions thereof, said operating mechanism including a rotatable actuator member movable between first and second positions thereof, resilient biasing means resiliently movable between loaded and unloaded positions thereof, linkage means between said actuator member and said biasing means, said linkage means comprising gear disc means for moving said biasing means between the loaded and unloaded positions thereof in response to movement of said actuator member between the first and second positions thereof, said biasing means being operatively connected to said movable body component such that when said movable body component is in the first position thereof movement of said biasing means from the unloaded position thereof to the loaded position thereof causes said movable body component to be biased toward the second position thereof, and means for dampening the movement of said movable body component between the first and second positions thereof.

2. A toy vehicle comprising:

a) a body and chassis assembly including a main body portion and at least one movable body component which is movable relative to said main body portion between first and second positions thereof; and b) an operating mechanism for moving said movable body component between the first and second positions thereof, said operating mechanism including an actuator member movable between first and second positions thereof, resilient biasing means resiliently movable between loaded and unloaded positions thereof, said actuator member being rotatable about an axis thereof for movement between the first and second positions thereof, linkage means including a rotatable linkage member which is rotatable about an axis which is substantially perpendicular to the axis of said actuator member for moving said biasing means between the unloaded and loaded positions thereof, said linkage means being disposed between said actuator member and said biasing means and being operative for moving said biasing means between the loaded and unloaded positions thereof in response to movement of said actuator member between the first and second positions thereof, said actuator member being rotatable about said axis thereof for movement between the first and second positions thereof, said linkage means including a linkage member which is longitudinally movable for moving said biasing means between the unloaded and loaded positions thereof, said biasing means being operatively connected to said movable body component such that when said movable body component is in the first position thereof movement of said biasing means from the unloaded position thereof to the loaded position thereof causes said movable body component to be biased toward the second position thereof, and means for dampening the movement of said movable body component between the first and second position is thereof.

3. In the toy vehicle of claim 2, said linkage means further characterized as a first linkage means, said operating mechanism further comprising second linkage means, said resilient biasing means being operatively connected to said movable body component through said second linkage means.

4. In the toy vehicle of claim 3, said dampening means including a viscous dampening fluid operatively interposed between said biasing means and said second linkage means so that the movement of said second linkage means is dampened by said viscous fluid.

5. In the toy vehicle of claim 2, said actuator member comprising a key socket and a key, said key socket being operatively connected to said linkage means for moving the latter between first and second positions thereof in order to move said biasing means between the unloaded and loaded positions thereof, said key being receivable in said key socket for rotating said key socket to move said movable linkage means between the first and second positions thereof.

6. In the toy vehicle of claim 3, said first and second linkage means further characterized as first and second rotatable disks, said first and second rotatable disks being rotatable between the first and second positions thereof, respectively.

7. In the toy vehicle of claim 6, said dampening means comprising a cavity member having a circular cavity therein and said viscous fluid being disposed in said cavity, said second rotatable disk being disposed at least partially in said cavity and contacting said viscous fluid such that rotation of said second rotatable disk in said cavity is dampened by said viscous fluid.

8. In the toy vehicle of claim 6, said cavity member being mounted in a stationary position relative to the main portion of said body and chassis assembly.

9. In the toy vehicle of claim 8, said actuator member comprising a key socket and a key, said key socket being operatively connected to said first rotatable disk such that rotation of said key socket causes corresponding rotation of said first rotatable disk, said key being receivable in said key socket for rotating said key socket to rotate said first rotatable disk.

10. In the toy vehicle of claim 2, said movable body component further characterized as an exterior body component.

11. In the toy vehicle of claim 4, said second linkage means comprising a cylinder member having an open cavity formed therein, said cavity being defined by an inner cylinder wall, said dampening means comprising a shaft rotatably received in said cavity, said viscous damping fluid being received in said cavity between said cylinder wall and said shaft for dampening the rotation of said shaft in said cylinder member.

12. In the toy vehicle of claim 11, said shaft having a non-circular transverse cross section.

13. A toy vehicle comprising:

a) a body and chassis assembly including a main body portion and at least one movable body component which is movable relative to said main body portion between first and second positions thereof; and b) an operating mechanism for moving said movable body component between the first and second positions thereof, said operating mechanism including an actuator member movable between first and second positions thereof, resilient biasing means resiliently movable between loaded and unloaded positions thereof, linkage means between said actuator member and said biasing means for moving said biasing means between the loaded and unloaded positions thereof in response to movement of said actuator member between the first and second positions thereof, said actuator member being rotatable about an axis thereof for movement between the first and second positions thereof, said linkage means including a linkage member which is longitudinally movable for moving said biasing means between the unloaded and loaded positions thereof, said biasing means being operatively connected to said movable body component such that when said movable body component is in the first position thereof movement of said biasing means from the unloaded position thereof to the loaded position thereof causes said movable body component to be biased toward the second position thereof, and means for dampening the movement of said movable body component between the first and second positions thereof.

14. In the toy vehicle of claim 13, said dampening means including a viscous dampening fluid operatively interposed between said biasing means and said second linkage means so that the movement of said second linkage means is dampened by said viscous fluid said dampening means comprising a cylinder member having an open cavity therein, said cylinder member being fixed relative to the main portion of said body and chassis assembly, said viscous fluid being disposed in said cavity in said cylinder member, said second linkage means comprising a piston element in sad cylinder member, said piston element being longitudinally movable in said cylinder member.

15. A toy vehicle comprising:

a) a body and chassis assembly including a main body portion and at least one movable body component which is movable relative to said main body portion between first and second positions thereof; and b) an operating mechanism for moving said movable body component between the first and second positions thereof, said operating mechanism including rotationally activated linear displacing actuator member movable between first and second positions thereof, resilient biasing means resiliently movable between loaded and unloaded positions thereof, linkage means between said actuator member and said biasing means for moving said biasing means between the loaded and unloaded positions thereof in response to linear displacement of said linkage means upon movement of said actuator member between the first and second positions thereof, said biasing means being operatively connected to said movable body component such that when said movable body component is in the first position thereof movement of said biasing means from the unloaded position thereof to the loaded position thereof causes said movable body component to be biased toward the second position thereof, and means for dampening the movement of said movable body component between the first and second positions thereof.

* * * * *